United States Patent [19]

Turner, Jr.

[11] 4,182,055

[45] Jan. 8, 1980

[54] SHOE CONSTRUCTION WITH PRE-FORMED SOLE

[75] Inventor: Newton C. Turner, Jr., Nashville, Tenn.

[73] Assignee: Genesco, Inc., Nashville, Tenn.

[21] Appl. No.: 841,677

[22] Filed: Oct. 13, 1977

[51] Int. Cl.[2] ..... A43B 13/12; A43B 9/10; A43B 13/04

[52] U.S. Cl. ..... 36/30 R; 36/16; 36/17 R; 36/32 R

[58] Field of Search ..... 36/30 R, 16, 17 R, 22, 36/32 R

[56] References Cited

U.S. PATENT DOCUMENTS

| | | | |
|---|---|---|---|
| 1,282,400 | 10/1918 | Egerton | 36/30 R |
| 2,996,814 | 8/1961 | Baker | 36/16 X |
| 3,972,135 | 8/1976 | Pietraszer | 36/30 R |
| 4,001,954 | 1/1977 | Taylor, Jr. | 36/16 |
| 4,012,853 | 3/1977 | Turner, Jr. | 36/17 R |

FOREIGN PATENT DOCUMENTS

| | | | |
|---|---|---|---|
| 2453534 | 5/1976 | Fed. Rep. of Germany | 36/32 R |
| 986612 | 4/1951 | France | 36/16 |
| 481667 | 6/1953 | Italy | 36/16 |
| 1017847 | 1/1966 | United Kingdom | 36/30 R |
| 1258047 | 12/1971 | United Kingdom | 36/32 R |

*Primary Examiner*—James Kee Chi

*Attorney, Agent, or Firm*—Harrington A. Lackey

[57] ABSTRACT

A shoe construction including a pre-formed unitary sole member made from a flexible, resilient material and including a concave top face pre-shaped to fit the bottom of the wearer's foot. The outer marginal portion of the bottom face of the sole member is recessed to form a stitching land for securing the sole member directly to the forepart lower marginal portion of the shoe upper. A soft, resilient sole filler member may be secured to the top face of the sole member, with the rear portion of the sole filler member being secured to the front portion of the shank tuck.

7 Claims, 4 Drawing Figures

SHOE CONSTRUCTION WITH PRE-FORMED SOLE

BACKGROUND OF THE INVENTION

This invention relates to a shoe construction, and more particularly to a shoe construction with a pre-formed sole.

Although it is known in the art to pre-form plastic outsoles by molding the plastic outsoles to the proper size and 2-dimensional shape, nevertheless such pre-formed outsoles are not pre-shaped snugly to fit the bottom of the last, nor the bottom of the wearer's foot. Moreover, conventional outsoles are usually not secured or stitched directly to the lower margins of an upper without also securing the outsole to an insole member.

SUMMARY OF THE INVENTION

It is an object of this invention to provide a shoe construction including a novel, pre-formed, unitary, forepart sole member which has a concave top face generally conforming to the forepart bottom of the last or the wearer's foot. The sole member includes outer marginal side and front edge portions recessed to have a lesser thickness than the inner portion of the sole member to form a stitching land, which is easily stitched directly to the outwardly turned, lower marginal portions of the forepart of the upper.

Although no conventional insole is employed, nevertheless a soft, resilient, sole filler member is secured to the top face of the sole member. The filler member preferably includes a relatively thick layer of foam material with its top face covered by a thin fabric sheet. The rear surface of the fabric sheet is adhesively secured to the overlapping front portion of the shank tuck, while the rear edge portion of the sole member, which has a rearwardly diminishing thickness, is secured by stitching to the front surface of a shank cover.

The remainder of the shoe construction is substantially conventional, since the shank cover, shank tuck and the lower margins of the backpart of the upper are all backpart-lasted in a conventional manner.

The sole member is made preferably from a flexible, resilient, homogeneous, thermoplastic material, such as polyurethane. The material is sufficiently resilient and expansive that it closes about the threads stitched through the needle holes formed in the stitching land of the sole member, not only to improve the locking of the threads to the stitched parts, but also to minimize the passage of water through the needle holes.

Preferably, a thin layer of a conventional waterproofing film is spread over the stitching land, and subsequent to stitching is, activated by heat to completely waterproof the sole margin of the shoe.

The flexibility and resiliency of the sole material renders the shoe very comfortable to wear and permits the sole material to yield to the thrust and impact of hard and sharp objects and to absorb shocks to the foot of the wearer.

The recessed outer marginal portion of the sole member facilitates the stitching of the margins of the outsole to the lower marginal portions of the forepart of the upper, presenting less resistance to the needles of the stitching machines, only in the stitching area along the margins of the sole member, without diminishing the protective thickness of the inner portions of the sole member.

The sole filler member further adds to the comfort of the wearer, and further reduces shock and impact to the foot of the wearer.

The outer margin of the sole is secured to the lower margin of the forepart of the upper, first by a fine line of stitching primarily to assemble the sole member and the upper together and establish the ultimate form of the forepart of the shoe. Later, a line of heavier thread is lock-stitched through the same stitching land and the lower margin of the forepart of the upper, overlapping or adjacent the line of fine stitching, in order to securely hold the parts together. This lock-stitching may be effected by a Goodyear lock stitch machine.

Thus, with the forepart of the upper and the sole attaining their ultimate form merely by the above stitching operation, only the backpart of the shoe has to be backpart-lasted in any conventional manner to establish the ultimate form of the backpart of the shoe.

DESCRIPTION OF THE PREFERRED EMBODIMENT

Figure 3:
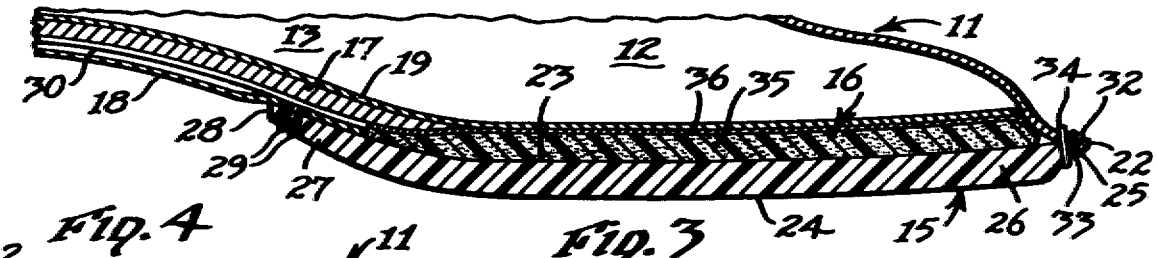
FIG. 3 is an enlarged, fragmentary section taken along the line 3—3 of FIG. 2.

Referring now to the drawings in more detail, the shoe 10 made in accordance with this invention basically includes an upper 11 having a forepart 12 and a backpart 13, a pre-formed forepart sole member 15, a sole filler member 16, a tuck shank 17, a shank cover 18, a full-length sock liner 19 and a heel 20.

Figure 1:
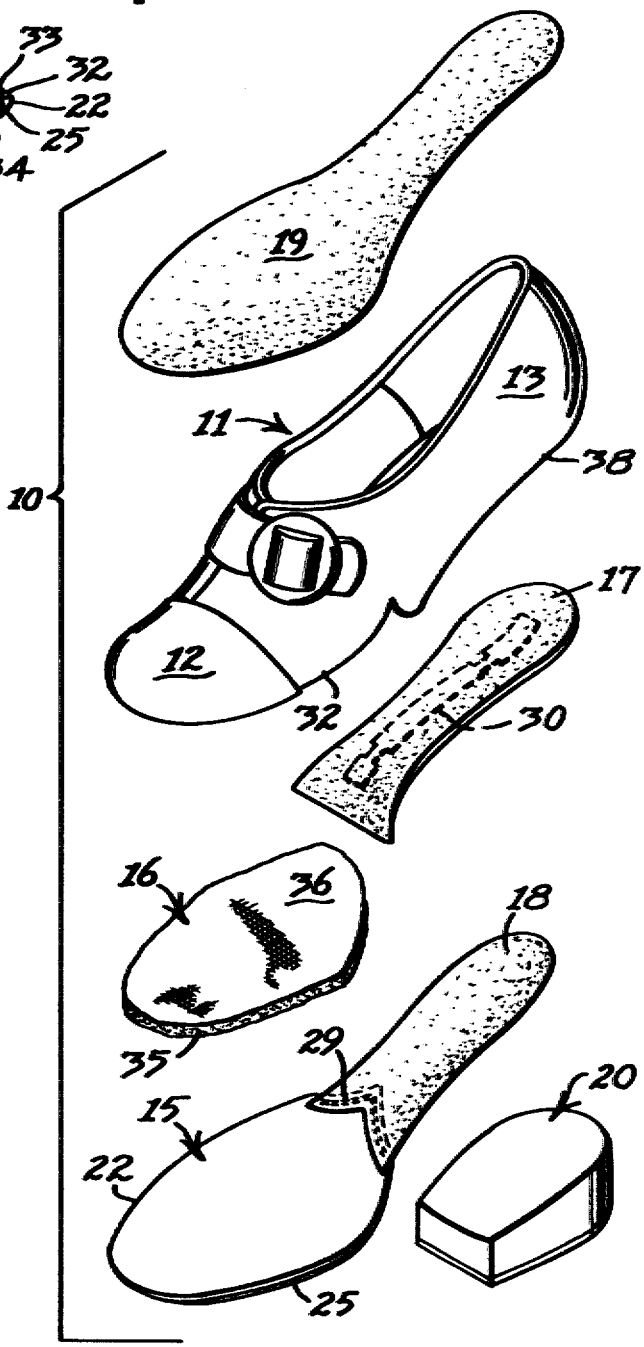
FIG. 1 is an exploded, top perspective view of the elements of a shoe made in accordance with this invention.

In the manufacture of the shoe 10, the pieces of the upper 11 are first cut out in the desired pattern and fixed together in a conventional manner, as disclosed in FIG. 1. The interior of the forepart 12 is provided with a box toe, not shown, while the interior of the backpart 13 is proved with a counter, not shown, in a conventional manner.

The forepart outsole or outsole member 15 is a solid, unitary member which is pre-formed, such as by molding from a flexible, resilient, homogeneous thermoplastic material, preferably polyurethane. The outsole member 15 is pre-formed to have an outer marginal edge 22 extending along both sides and the front and contoured to the outer configuration of the forepart of the shoe 10. The top face 23 of the outsole member 15 is generally concave and pre-shaped to fit the bottom of the forepart of the last or the forepart of the bottom of the wearer's foot, so thatno additional forming or shaping of the sole 15 is required. The general contours of the top face 23 and the convex bottom face 24 of the sole member 15 are best disclosed in the longitudinal and transverse dimensions illustrated in FIGS. 3 and 4 of the drawings.

Figure 4:
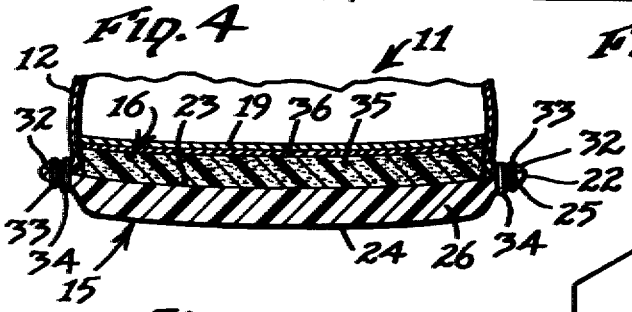
FIG. 4 is an enlarged, fragmentary section taken along the line 4—4 of FIG. 2.
Figure 2:
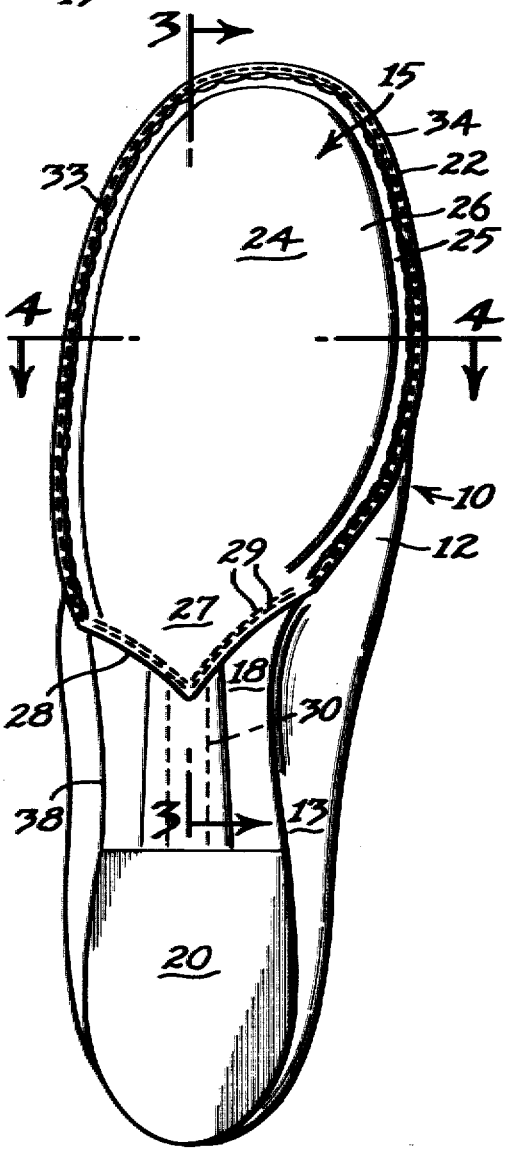
FIG. 2 is an enlarged, bottom plan view of the completed shoe.

As best disclosed in FIGS. 2, 3 and 4, the front and side marginal surfaces of the bottom face 24 of the sole member 15 are recessed continuously and coextensively with the outer marginal edge 22 to form a stitching land 25 of reduced thickness from the generally uniform thickness of the sole member 15, and particularly from the greater thickness of the entire inner portion 26 of the sole member 15.

As best disclosed in FIG. 3, the rear edge portion 27 of the sole member 15 tapers, or has rearward diminishing thickness, terminating in the rear edge 28. The reduced thickness of the rear edge portion 27 of the sole member 15 permits the rear edge portion 27 to be more easily stitched by threads 29 to the overlapping shank cover 18.

The shank tuck 17 is secured to an elongated, preformed steel shank member 30.

The parts of the shoe 10, thus far described in their pre-formed and pre-assembled conditions are disclosed separately in FIG. 1.

The forepart sole member 15 is next secured to the forepart 12 of the upper 11, by turning outward the forepart lower marginal portions 32 of the upper 12 and stitching a line of fine thread 33 through the lower marginal portions 32 and the stitching land 25 completely around the sides and front of the outsole member 15, by a conventional stitching machine.

After the fine line of stitching 33 has been completely sewn through the sides and front of the forepart margins of the upper forepart 12 and the sole member 15, both the sole member 15 and the upper 12 automatically conform to their ultimate or final shape in the construction of the shoe 10.

In order to form a "permanent" or final bond between the upper 12 and the outsole member 15, a heavier line of stitching 34 is sewn through the lower marginal portions 32 of the upper 12 and the stitching land 25, by a conventional heavy shoe-stitching machine, such as a Goodyear lock-stitch machine.

To complete the shoe construction, the sole filler member 16 is secured to the top face of the sole member 15. The filler member 16 consists of a thick layer of foam material 35, to the top surface of which is bonded a thin layer of a fabric sheet 36. The bottom surface of the foam layer 35 is adhesively bonded to the top surface 23 of the sole member 15. Since the sole filler member 16 is substantially coextensive with the forepart outsole member 15, the edges of the filler member 16 partially fill and cover the stitched joint between the upper marginal portions 32 and the stitching land 25.

The top fabric sheet 36 not only provides a wear surface for protecting the foam layer 35, but also provides along its rear portion a surface for bonding the sole filler 16 to the overlapping bottom surface of the front portion of the shank tuck 17.

The elements of the shoe 10 pre-assembled to this point, may be slip-lasted, and the shank tuck 17, shank cover 18, and the backpart lower marginal edges or portions 38 may all be backpart-lasted, such as by side-lasting and heel-lasting by appropriate and conventional methods.

The heel 20 is then secured to the rear portion of the shank cover 18 to complete the construction of the shoe 10, as viewed in FIG. 2.

The shoe 10 may then be completed by other finishing steps and operations in a well-known manner.

The resilience and expansibility of the thermoplastic material, such as polyurethane, used in the pre-formed or molded sole member 15, are such that the material will automatically expand to close against the threads in the lines of stitching 33 and 34, as well as the lines of stitching 29, extending through the holes formed by the needles of the stitching machines. Thus, the expansibility of material prevents most of the water encountered by the shoe 10 from passing through the stitch holes.

In order to perfect this waterproofing effect, a thin layer of a conventional waterproofing film, not shown, is applied to the forepart marginal portion 32 and to the stitching land 25. After stitching, the film is heat-activated to completely waterproof the area around the perimeter of the sole member 15.

The thermoplastic material of the sole member 15 is, of course, inherently waterproof, as opposed to conventional leather outsoles.

The resiliency and flexibility of the forepart sole member 15, and also the absence of a conventional insole, as well as the absence of a relatively stiff outsole, provides a shoe 10 of considerable comfort, as well as protection for the wearer's foot.

What is claimed is:

1. In a shoe construction, (a) an upper having a forepart lower marginal portion and a backpart lower marginal portion, (b) a pre-formed, unitary, sole member, having an outer marginal edge extending around the forepart sides and front of said sole member, (c) said sole member having a concave top face generally conforming to the portion of the bottom surface of the shoe wearer's foot against which the sole member is designed to fit, and a bottom face, (d) said top face being laterally coextensive with said outer marginal edge, (e) a marginal recessed portion in said bottom face adjacent to, merging with, and coextensive with said outer marginal edge to form a marginal stitching land, and an inner portion of said sole member, (f) said stitching land comprising a bottom surface gradually inclining laterally outward and gradually curving concave downward laterally between said inner portion and said outer marginal edge to merge with said outer marginal edge, and to form a relatively thin, outward tapering, outer portion of said stitching land, (g) a first line of fine stitching securing said forepart lower marginal portion to said relatively thin outer portion of said stitching land, and (h) a second line of heavy stitching securing said forepart lower marginal portion generally to a relatively thicker portion of said stitching land than the portion secured by said first line of stitching.

2. The invention according to claim 1 in which said second line of heavy stitching is spaced inward from said first line of fine stitching.

3. The invention according to claim 1, in which said sole member comprises a forepart sole member, and said outer marginal edge comprises front and side outer marginal edges.

4. The invention according to claim 3, further comprising a back marginal edge on said sole member and a back marginal portion having a rearward dimishing thickness terminating in said back marginal edge, a shank cover secured to said backpart lower marginal portion, and stitch means securing said shank cover to the back marginal portion of said sole member.

5. The invention according to claim 1, in which said sole member is formed of a flexible, resilient, homogenous, thermoplastic material.

6. The invention according to claim 5, in which said material is polyurethane.

7. The invention according to claim 5, in which said material around the needle holes formed by said stitching in said stitching land closes tightly around the threads stitched through said needle holes.

* * * * *